US005937810A

United States Patent [19]

Sato et al.

[11] Patent Number: 5,937,810

[45] **Date of Patent: *Aug. 17, 1999**

[54] VALVE TIMING CONTROL DEVICE

[75] Inventors: Atsushi Sato, Kariya; Kongo Aoki, Toyota; Naoki Kira, Anjo; Kenji Fujiwaki, Kariya, all of Japan

[73] Assignee: Aisin Seiki Kabushiki Kaisha, Aichi-pref., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/758,857

[22] Filed: Dec. 2, 1996

[30] Foreign Application Priority Data

Nov. 30, 1995 [JP] Japan ..... 7-313271
Nov. 30, 1995 [JP] Japan ..... 7-313391

[51] Int. Cl.[6] ..... F01L 1/344

[52] U.S. Cl. ..... 123/90.17; 123/90.31

[58] Field of Search ..... 123/90.15, 90.17, 123/90.31; 74/567, 568 R; 464/1, 2, 160

[56] References Cited

U.S. PATENT DOCUMENTS 4,858,572 8/1989 Shirai et al. ..... 123/90.12
5,507,254 4/1996 Melchoir ..... 123/90.17
5,520,145 5/1996 Nagai et al. ..... 123/90.17

FOREIGN PATENT DOCUMENTS

A-518529 12/1992 European Pat. Off. .
A-590696 4/1994 European Pat. Off. .
A-3937644 5/1991 Germany .
Syou 60-175738 9/1985 Japan .
Syou 61-1833 1/1986 Japan .
2-50105 4/1990 Japan .
5-113112 5/1993 Japan .
WO95/31633 11/1995 WIPO .

*Primary Examiner*—Weilun Lo
*Attorney, Agent, or Firm*—Hazel & Thomas, P.C.

[57] ABSTRACT

A valve timing control device includes a rotor fixed on a cam shaft, a housing member rotatably mounted on the cam shaft so as to surround the rotor, a chamber defined between the housing member and the rotor and having a pair of circumferentially opposed walls, a vane mounted on the rotor and extended outwardly therefrom in the radial direction into the chambers so as to divide each of chambers into a first pressure chamber and a second pressure chamber, a fluid supplying device for supplying fluid under pressure to at least a selected one of the first pressure chamber and the second pressure chamber, and a concave portion formed on the radially outer ends of the opposed walls of the chamber.

14 Claims, 6 Drawing Sheets

VALVE TIMING CONTROL DEVICE

BACKGROUND OF THE INVENTION

1. Field of the Invention

The present invention relates to a valve timing control device and is particular to a valve timing control device for controlling an angular phase difference between a crank shaft of a combustion engine and a cam shaft of the combustion engine.

2. Description of the Prior Art

In general, a valve timing of a combustion engine is determined by valve mechanisms driven by a cam shaft according to a characteristic of the combustion engine or the use of the combustion engine. Since a condition of the combustion may change in response to the rotational speed of the combustion engine, however, it is difficult to obtain an optimum valve timing through the whole rotational range. Therefore, in recent years, a valve timing control device which is able to change a valve timing in response to the condition of the combustion engine has been proposed as an auxiliary mechanism of the valve mechanism.

A conventional device of this kind is disclosed, for example, in U.S. Pat. No. 4,858,572. This device includes a rotor fixed on the cam shaft, a drive member driven by the rotational torque from a crank shaft and which rotatably mounted on the cam shaft so as to surround the rotor, a plurality of chambers that are defined between the drive member and the rotor and that each has a pair of circumferentially opposed walls and a plurality of vanes that are mounted to the rotor and extend outwardly therefrom in the radial direction into the chambers so as to divide each of the chambers into a first pressure chamber and a second pressure chamber. In this device, a fluid under pressure is supplied to a selected one of the first pressure chamber and the second pressure chamber in response to the running condition of the combustion engine and an angular phase difference between the crank shaft and the cam shaft is controlled so as to advance or retard the valve timing relative to the crank shaft. The valve timing control device is in the position of the maximum advanced condition, when each of the vanes contacts with one of the opposed walls of each of the chambers. On the other hand, the valve timing control device is in the position of the maximum retarded condition, when each of vanes contacts with the other of the opposed walls of each of the chambers.

In the above prior art device, if the fluid which contains foreign matter is supplied to the chamber and foreign matter gets in between the vane and the opposed wall in the above mentioned maximum advanced or retarded condition, it is not able to exactly obtain the maximum advanced or retarded condition. As a result, it is impossible to exactly control the valve timing with that device. Further, if the foreign matter gets in between the top end portion of the vane and an outer circumferential wall of the chamber, the fluid-tightness between the first pressure chamber and the second pressure chamber deteriorates. This causes a decrease in the response of the valve timing control device.

SUMMARY OF THE INVENTION

It is, therefore, an object of the present invention to provide an improved valve timing control device which overcomes the above drawbacks.

It is another object of the present invention to provide an improved valve timing control device which can exclude any detrimental effects of the foreign matter in the fluid.

In order to achieve these objectives, there is provided an improved valve timing control device which includes a rotor fixed on a cam shaft, a housing member rotatably mounted on the cam shaft so as to surround the rotor, a chamber defined between the housing member and the rotor and having a pair of circumferentially opposed walls, a vane mounted on the rotor and extended outwardly therefrom in the radial direction into the chamber so as to divide each of chamber into a first pressure chamber and a second pressure chamber, a fluid supplying means for supplying fluid under pressure to at least a selected one of the first pressure chamber and the second pressure chamber, and a concave portion formed on the radially outer ends of the opposed walls of the chamber.

BRIEF DESCRIPTION OF THE DRAWINGS

Additional objects and advantages of the present invention will become more apparent from the following detailed description of a preferred embodiment thereof when considered with reference to the attached drawings, in which.

DETAILED DESCRIPTION OF THE PREFERRED EMBODIMENT

A valve timing control device in accordance with preferred embodiments of the present invention will be described with reference to the attached drawings.

Figure 1:
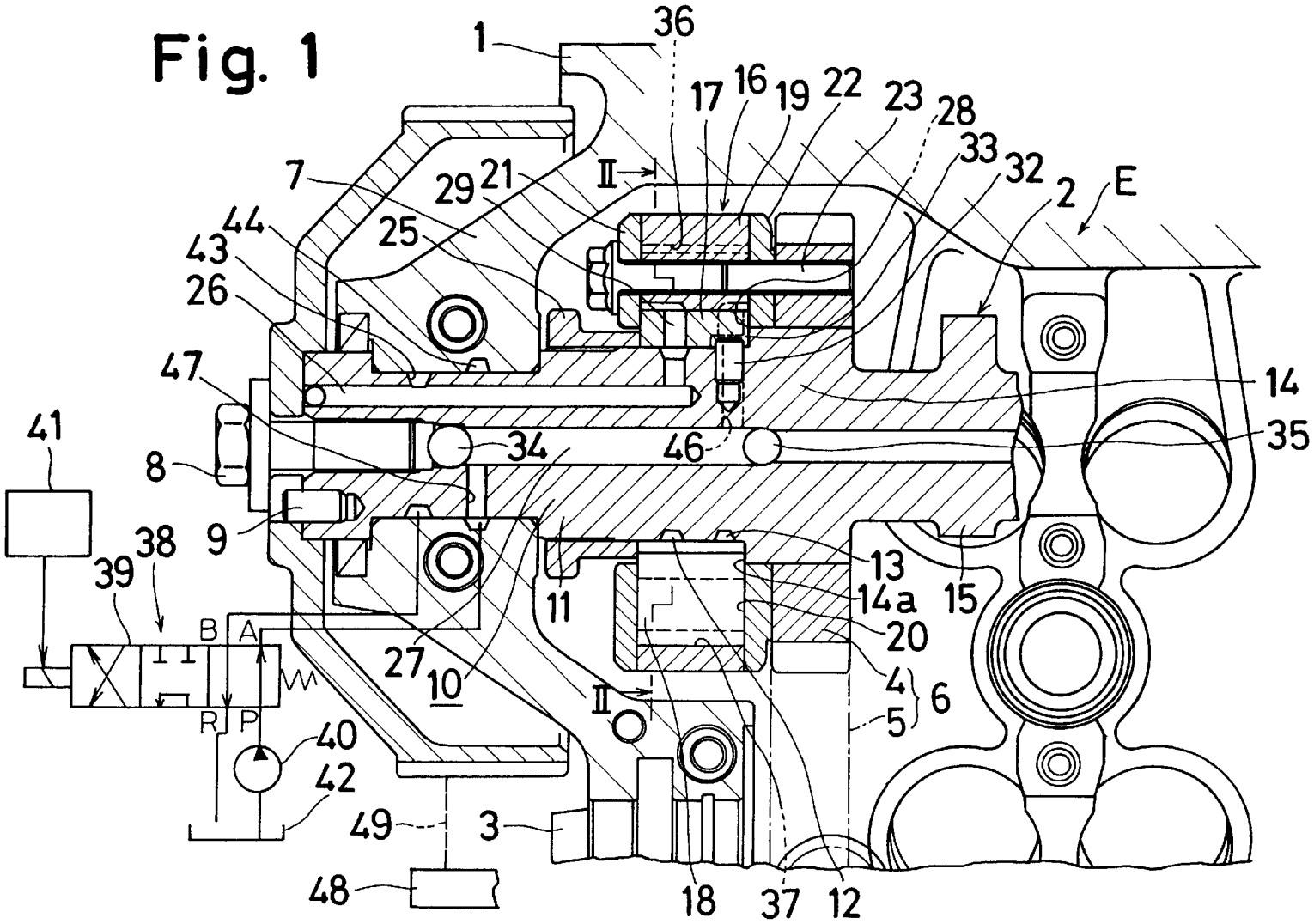
FIG. 1 shows a sectional view of an first embodiment of a valve timing control device in accordance with the present invention.
Figure 2:
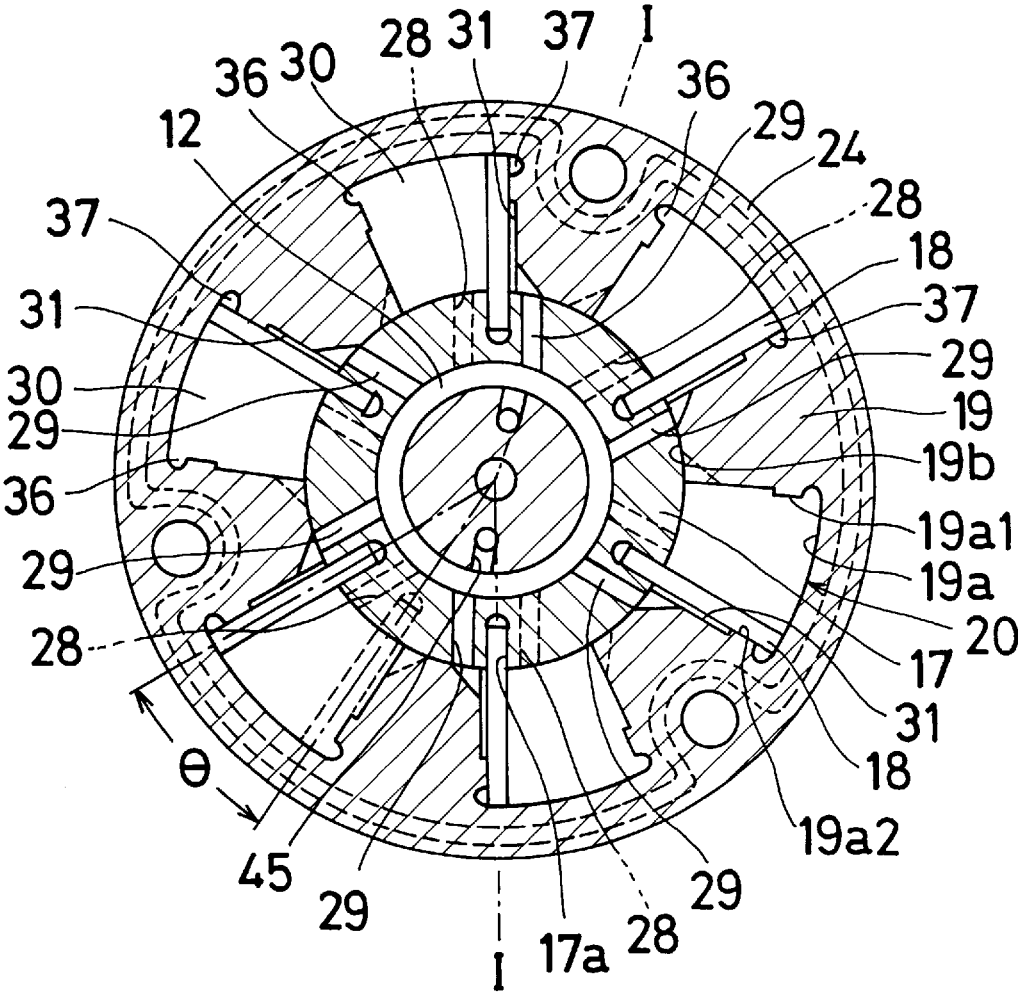
FIG. 2 shows a cross-sectional view taken along line II—II of FIG. 1.

FIG. 1 and FIG. 2 show a first embodiment of the present invention. In this first embodiment, a valve timing control device according to the present invention is applied to a DOHC (Double Over Head Cam Shaft) engine E.

Referring to FIG. 1, an exhaust cam shaft 2 (a first cam shaft) and an intake cam shaft 3 (a second cam shaft) are rotatably mounted on a cylinder head 1 of an engine and are connected to each other by a rotational torque transmitting means 6. The rotational torque transmitting means 6 is comprised of a gear 4 which is rotatably mounted on the exhaust cam shaft 2 and a gear 5 which is fixedly mounted on the intake cam shaft 3.

An end of the exhaust cam shaft 2 is projected out of the cylinder head 1 and a timing pulley 7 is fixed to this projecting end of the exhaust cam shaft 2 by a bolt 8. A stopper pin 9 is fixed to the projecting end of the exhaust cam shaft 2 and is fitted into a notch formed on the timing pulley 7 so that the relative rotation between the timing pulley 7 and the exhaust cam shaft 2 is prevented. Rotational torque is transmitted to the timing pulley 7 via a belt 49 from a crank shaft 48 which is rotated by the engine E.

An cylindrical portion 10 of the exhaust cam shaft 2 which extends into the cylinder head 1 is provided with a male screw portion 11 on which a male screw is formed and a passage portion on which two circular grooves 12, 13 are formed in order from a front side (left side in FIG. 1). The circular grooves 12, 13 are formed so as to maintain a predetermined distance between each other. At the adjacent portion of the passage portion (at the right side of the passage portion in FIG. 1), a journal portion 14 having a larger diameter than that of the passage portion is formed and a plurality of cam portions 15 are continuously formed at the right side of the journal portion 14. On the journal portion 14, the gear 4 has three female screw holes which are formed in the axial direction and separated in the circumferential direction at regular intervals is rotatably mounted thereon.

On the passage portion of the exhaust cam shaft 2, a valve timing control mechanism 16 is mounted thereon. As shown in FIG. 2, the valve timing control mechanism 16 includes a rotor 17, six vanes 18, a housing member 19, a circular front plate 21 and a circular rear plate 22. The rotor 17 has a cylindrical shape and is fixedly mounted on the passage portion of the exhaust cam shaft 2 by a pin 32. The pin 32 is pressed in the passage portion of the exhaust cam shaft 2 in the radial direction and is fitted into a notch portion 33 formed on the inner circumferential portion of the rotor 17 so that relative rotation between the rotor 17 and the exhaust cam shaft 2 is prevented. The housing member 19 has a cylindrical shape with an inner bore 19*b* and is rotatably mounted on the outer circumferential surface of the rotor 17 so as to surround the rotor 17. The housing member 19 has the same axial length as the rotor 17 and is provided with six grooves 19*a* which are outwardly extended from the inner bore 19*b* in the radial direction and which are separated in the circumferential direction at regular intervals. The housing member 19 is also provided with three holes that penetrate in the axial direction and are separated in the circumferential direction at regular intervals. The rear plate 22 is rotatably mounted on the journal portion 14 so as to be located between the gear 4 and one side face of the housing 19. The rotor 17 and is provided with three holes that penetrate in the axial direction and are separated in the circumferential direction at regular intervals. The front plate 21 is located so as to be opposite to the other side faces of the housing member 19 and the rotor 17 and is provided with three holes that penetrate in the axial direction and are separated in the circumferential direction at regular intervals. Three bolts 23 are fitted into the holes of the front plate 21, the housing member 19 and the rear plate 22 and are screwed into the female screw holes of the gear 4. Seal members 24 are interposed between the front plate 21 and the other side face of the housing 19 and between the rear plate 22 and one side face of the housing 19, respectively. Thereby, the front plate 21 is fluid-tightly pressed to the other side face of the housing 19, and the rear plate 23 is fluid-tightly pressed to one side face of the housing 19. Now, one side face of the rotor 17 is contacted with a stepped portion 14a of the journal portion 14 and under this condition a nut 25, is screwed onto the male screw portion 11 of the exhaust cam shaft 2 so as to press the rotor 17 toward the journal portion 14. Thereby, rotor 17 is rotated with the exhaust cam shaft 2 in a body.

Thereby, six chambers 20 which are separated in the circumferential direction at regular intervals and each of which has a pair of circumferentially opposed walls 19*a*1, 19*a*2 are defined along the rotor 17, the housing member 19, the front plate 21 and the rear plate 22. On the outer circumferential portion of the rotor 17, six grooves 17*a* that extend inwardly therefrom in the radial direction and which are separated in the circumferential direction at regular intervals are formed thereon. Six vanes 18 that extend outwardly in the radial direction into the chambers 20 are mounted in the grooves 17*a,* respectively. Thereby, each of chambers 20 is divided into a first pressure chamber 30 and a second pressure chamber 31, both of which are fluid-tightly separated from each other. In this embodiment, grooves 36, 37 which are extended in the axial direction are formed on the radially outer end portions of the opposed walls 19*a*1, 19*a*2, respectively. These grooves 36, 37 correspond to a concave portion of the present invention, respectively.

The rotor 17 is provided with six first passages 28 and six second passages 29. One end of each of the first passages 28 communicates with the circular groove 13 and the other end of each of the first passages 28 communicates with each of the first pressure chambers 30. On the other hand, one end of each of the second passages 29 communicates with the circular groove 12 and the other end of each of the second passages 29 communicates with each of the second pressure chambers 31. The circular groove 13 communicates with a passage 27 which is formed in the exhaust cam shaft 2 at its axial center and extends in the axial direction via a passage 46. The circular groove 12 communicates with a pair of passages 26 which are formed in the exhaust cam shaft 2 so as to locate on the coaxial circle about the axial center of the shaft 2 and which are extended in parallel in the axial direction via passages 45. Now, in this embodiment, the passage 27 is formed at the same time the lubrication passage for the journal portions (not shown) which are located at the right side of the exhaust cam shaft 2 in FIG. 1 is formed. The passage 27 is separated from the lubrication passage by a ball 35 which is pressed into the lubrication passage and is separated from outside by a ball 34 which is pressed into the passage 27. On the other hand, the passages 26 are symmetrical about the passage 26 and have the same flow resistance as that of the passage 27. Therefore, the passages 26, 27 which have a predetermined flow resistance can be obtained by machining without increasing the diameter of the cam shaft 2.

A portion which is located between the cylindrical portion 10 and the projecting end portion of the exhaust cam shaft 2 is rotatably supported on the cylinder head 1 and a cover (not shown) and is provided with a circular groove 43. The circular groove 43 communicates with the passages 26. The supporting surfaces of the cylinder head 1 and the cover (not shown) for supporting the exhaust cam shaft 2 is provided with a circular groove 44. The circular groove 44 communicates with the passage 27 via a passage 47.

A fluid supplying device 38 is comprised of a changeover valve 39, a fluid pump 40 and a controller 41. In this embodiment, the changeover valve 39 is a four port—three position type electromagnetic valve. The fluid pump 40 is driven by the engine and discharges the fluid (=oil) for lubricating the engine. The pump 40 may be a pump for lubricating the engine. The circular groove 44 is communicated to a port A of the changeover valve 39 and the circular groove 43 communicates to a port B of the changeover valve 39. A port P of the changeover valve 39 communicates with a discharge portion the fluid pump 40 and a port R of the changeover valve 39 communicates with a reservoir 42. The position of the changeover valve 39 is controlled by the controller 41 so that a first condition in which the discharged fluid from the pump 40 is supplied to the circular groove 44 and in which the circular groove 43 communicates with the reservoir 42, a second condition in which the communication between the circular grooves 43, 44 and the pump 40 and the reservoir 42 is interrupted, respectively, and in which the discharged fluid from the pump 40 is supplied to the reservoir 42, and a third condition in which the discharged fluid from the pump 40 is supplied to the circular groove 43 and in which the circular groove 44 communicates with the reservoir 42 are selectively obtained. The controller 41 controls the above conditions of the changeover valve 39 based on parameter signals such as engine speed, the opening level of a throttle valve (not shown) and so on.

The operation of the valve timing control device having the above structure will now be described.

With the starting of the engine, the exhaust cam shaft 2 is rotated clockwise by the timing pulley 7 in FIG. 2. Thereby, exhaust valves (not shown) are opened and closed. Simultaneously, the rotor 17 is rotated and then gear 4 is rotated via the vanes 18, the housing member 19 and the bolts 23. The rotation of the gear 4 is transmitted to the gear 5 and then the intake cam shaft 3 is rotated so that intake valves (not shown) are opened and closed.

The gear 4 is rotatably mounted on the journal portion 14 of the exhaust cam shaft 2. Therefore, when the pressurized fluid is supplied from the pump 40 to the second pressure chambers 31 by the changeover valve 39 changed to the third condition via the circular groove 43, the passages 26 and 45, the circular groove 12 and the second passages 29, the housing member 19, the front plate 21 and the second plate 22 are rotated clockwise with the gear 4 relative to the exhaust cam shaft 2 in FIG. 2. As a result, the valve timing control mechanism 16 is in the maximum advanced condition position in which the vanes 18 are in contact with the walls 19*a*1 of the chambers 20 and in which the angular phase of the intake cam shaft 3 is advanced relative to that of the exhaust cam shaft 2 (=the crank shaft 48) by maximum value θ in FIG. 2. In this condition, when the pressurized fluid is supplied from the pump 40 to the first pressure chambers 30 by the changeover valve 39 changed to the first condition via the circular groove 44, the passages 47, 27 and 46, the circular groove 13 and the first passages 28, the housing member 19, the front plate 21 and the second plate 22 are rotated counterclockwise with the gear 4 relative to the exhaust cam shaft 2 in FIG. 2. Consequently, the valve timing control mechanism 16 is in the maximum retarded condition position in which the vanes 18 are in contact with the walls 19*a*2 of the chambers 20 and in which the angular phase of the intake cam shaft 3 is retarded relative to that of the exhaust cam shaft 2 (=the crank shaft 48) by maximum value 6 from the above mentioned maximum advanced condition. Now, depending on the manner in which the control of the changeover valve 39 is executed, the vanes 18 can be stopped in any position (intermediate advanced position) between the maximum advanced position and the maximum retarded position. This requires that balance be achieved between the fluid pressure of the first pressure chambers 30 and the fluid pressure of the second pressure chambers 31 when the vanes 18 have achieved an arbitrary position. The amount of the advance can therefore be set to any value between a zero level and a maximum level.

As mentioned above, the opening and closing timing of the intake valves (not shown) driven by the intake cam shaft 3 is adjusted and the angular phase difference between the crank shaft 48 and the intake cam shaft 3 is adjusted.

Figure 3:
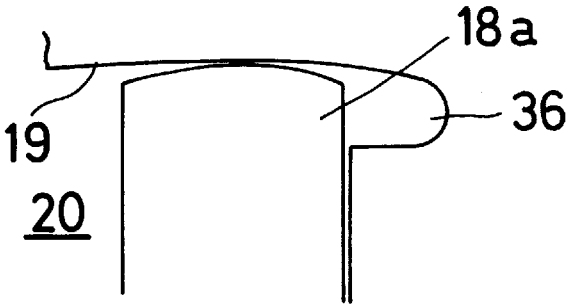
FIG. 3 shows an expanded sectional view of the essential parts of the present invention.

Further, in this embodiment, since the grooves 36 and 37 which are extended in the axial direction are formed on the radially outer end portions of the opposed walls 19*a*1 and 19*a*2, respectively, even if the fluid which contains foreign matter is supplied to the chambers 20, the foreign matter moves outwardly in the radial direction by the centrifugal force due to the rotation of the rotor 17 and is collected into the grooves 36 and 37 by the vanes 18. Accordingly, since foreign matter getting between the vanes 18 and the walls 19*a*1, 19*a*2 is prevented, the amount of the maximum advance or the maximum retard is always maintained at the predetermined amount. Further, if foreign matter is located between the vanes 18 and the walls 19*a*1, 19*a*2 and removed therefrom, the foreign matter will reach between the top end portion of the vanes 18 and the outer circumferential walls of the chambers 20 and the fluid-tightness between each of the first pressure chambers 30 or and each of the second pressure chambers 31 may deteriorate. In this embodiment, however, since the foreign matter is always collected into the grooves 36, 37, the deteriorating effects of the foreign matter is eliminated and therefore good response in the valve timing control device is maintained. Further, when each of the vanes 18 has a sharp-pointed edge portion 18*a* at its top portion as shown in FIG. 3, since the interference between each of the edge portions 18*a* and each of the radially outer end portions of the opposed walls 19*a*1 and 19*a*2 are prevented by each of the grooves 36, 37, the amount of the maximum advance or the maximum retard is always maintained at the predetermined amount. Now, the volume of each of the grooves 36, 37 is determined to be larger than the amount of foreign matter which is allowed to be contained in the fluid by the standards of the engine.

Figure 4:
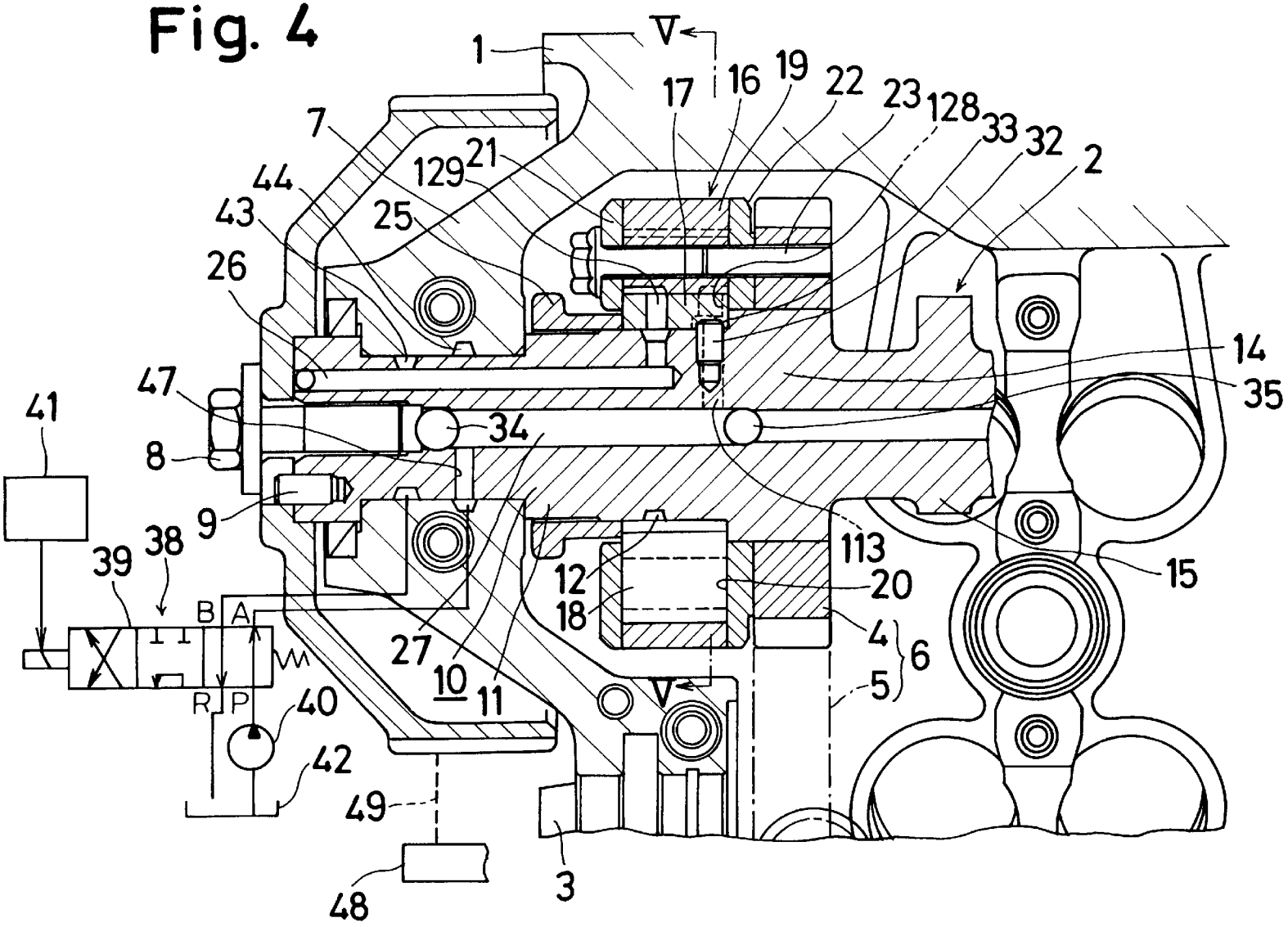
FIG. 4 shows a sectional view of an second embodiment of a valve timing control device in accordance with the present invention.
Figure 5:
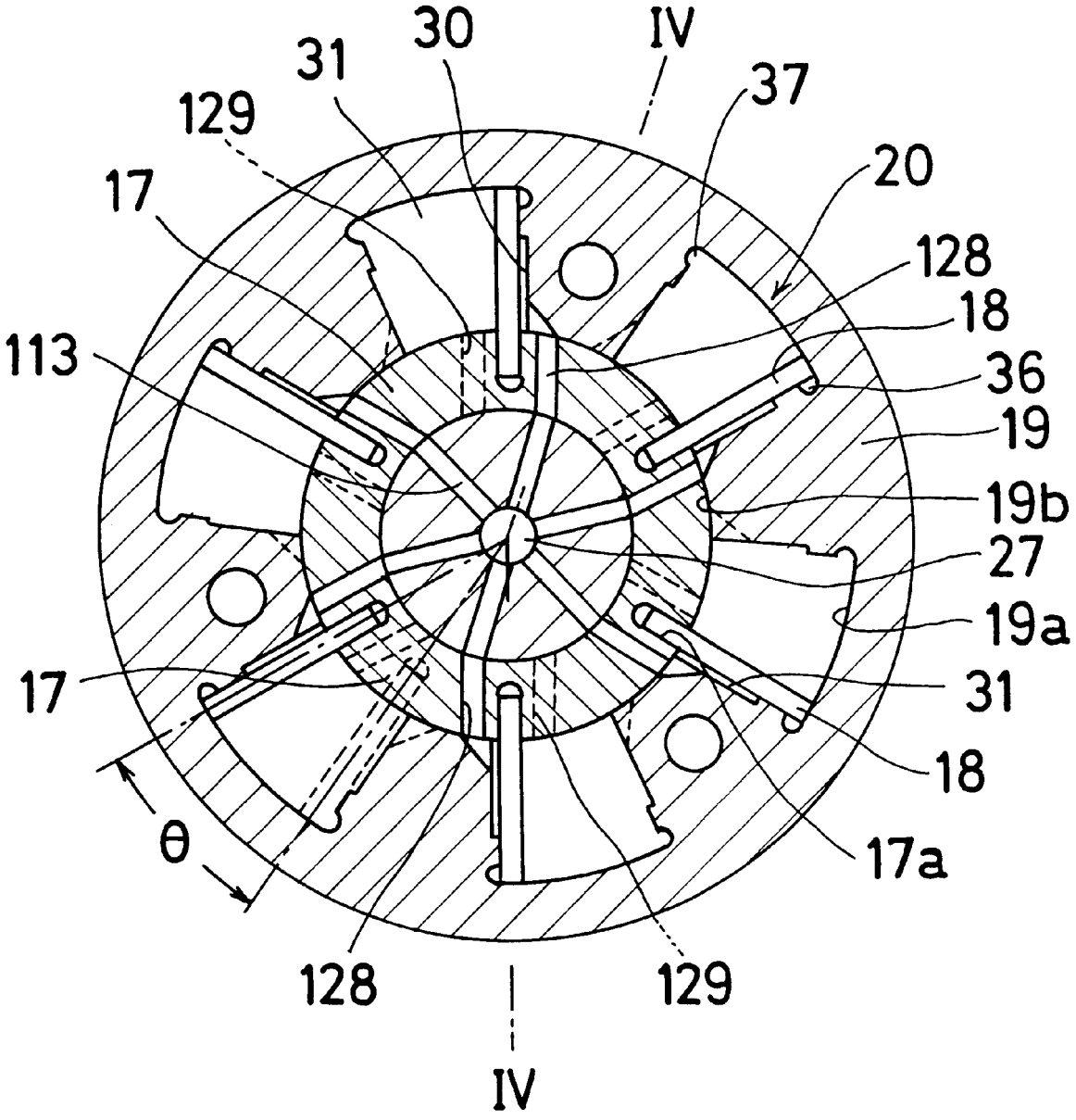
FIG. 5 shows a cross-sectional view taken along line V—V of FIG. 4.

FIG. 4 and FIG. 5 show a second embodiment of the present invention. In FIG. 4 and FIG. 5, the same parts as compared with FIG. 1 and FIG. 2 are identified by the same reference numerals.

Referring to FIG. 4 and FIG. 5, six passages 113 that extend outwardly from the passage 27 in the radial direction are formed on the exhaust cam shaft 2 so that each of the passages 113 always communicates with each of the first passages 128. According to this embodiment, since the length of the passage between the passage 27 and each of the first pressure chambers 30 becomes the same, the pressurized fluid is supplied from the pump 40 to each of the first pressure chambers 30 at the same time by the changeover valve 39 changed to the first condition via the circular groove 44, the passages 47, 27 and 113 and the first passages 128. As a result, the above mentioned relative rotation between the rotor 17 and the housing 19 is rapidly performed and the response of the valve timing control device is improved. Further, since this relative rotation is smoothly performed without being pulsatingly rotated, the adjusting operation is smoothly performed. Now, in this embodiment, the passages 113 communicate with the first pressure chambers 30 (retard side). However, it is able to communicate between the passages 27 and the second pressure chambers 31 (advance side) via the passages 113. In this case, the first pressure chambers 30 communicate with the passages 26 via the circular groove and the first passages. Further, it is able to communicate between the first pressure chambers 30 and the passage 27, and between the second pressure chambers 31 of the radially outer end portions of the opposed walls 19*a*1 and 19F 2 are prevented by each of the grooves 36, 37, the amount of the maximum advance or the maximum retard is always maintained at the predetermined amount. Now, the volume of each of the grooves 36, 37 is determined larger than the amount of foreign matter which is allowed to be contained in the fluid by a standard of the engine.

FIG. 4 and FIG. 5 show a second embodiment of the present invention. In FIG. 4 and FIG. 5, the same parts as compared with FIG. 1 and FIG. 2 are identified by the same reference numerals.

Referring to FIG. 4 and FIG. 5, six passages 113 which are extended outwardly from the passage 27 in the radial direction are formed on the exhaust cam shaft 2 so that each of the passages 113 is always communicated with each of the first passages 128. According to this embodiment, since the length of the passage between the passage 27 and each o f the first pressure chambers 30 becomes the same, the pressurized fluid is supplied from the pump 40 to each of the first pressure chambers 30 at the same time by the changeover valve 39 changed to the first condition via the circular groove 44, the passages 47, 27 and 113 and the first passages 128. Thereby, the above mentioned relative rotation between the rotor 17 and the housing 19 is rapidly performed and the response of the valve timing control device is improved. Further, since this relative rotation is smoothly performed without being pulsatingly rotated, the adjusting operation is smoothly performed. Now, in this embodiment, the passages 113 are communicated to the first pressure chambers 30 (retard side). However, it is able to communicate between the passages 27 and the second pressure chambers 31 (advance side) via the passages 113. In this case, the first pressure chambers 30 are communicated to the passages 26 via the circular groove and the first passages. Further, it is able to communicate between the first pressure chambers 30 and the passage 27 and between the second pressure chambers 31 and the passages 26 via the radially outwardly extending passages, respectively. When the passages 26 and 27 are not overlapped with each other in the axial direction, the pressurized fluid is supplied from the pump to each of the first pressure chambers at the same time and is supplied from the pump to each of the second pressure chambers at the same time. When the passages 26 and 27 are overlapped with each other in the axial direction, the passages 26 and 27 are formed so as not to be co-axial with respect to the axial center of the cam shaft and the number of the pressure chambers to which the pressurized fluid is supplied at the same time are limited.

According to this embodiment, since the grooves 36 and 37 which extend in the axial direction are formed on the radially outer end portions of the opposed walls 19*a*1 and 19*a*2, respectively, it is able to obtain the same effects as the above first embodiment. Now, in this embodiment, the contacting portions between the front plate 21 and the housing member 19 and between the rear plate 22 and the housing member 19 are sealed by a metal touch, respectively. However, it is able to interpose a seal member which is bent so that the bolts 23 are located outside of the seal portion, respectively as shown in FIG. 2.

Figure 6:
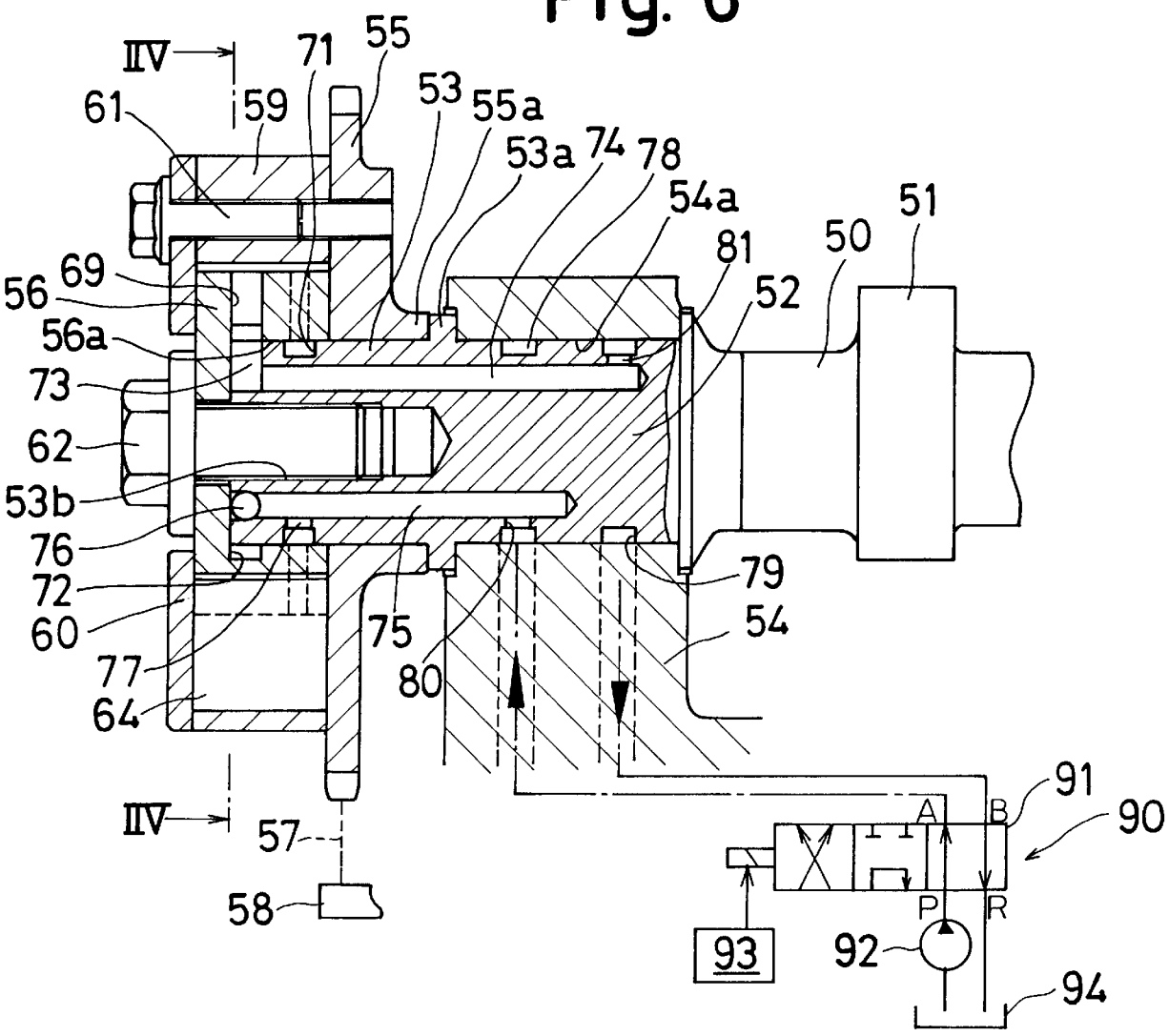
FIG. 6 shows a sectional view of an third embodiment of a valve timing control device in accordance with the present invention.
Figure 7:
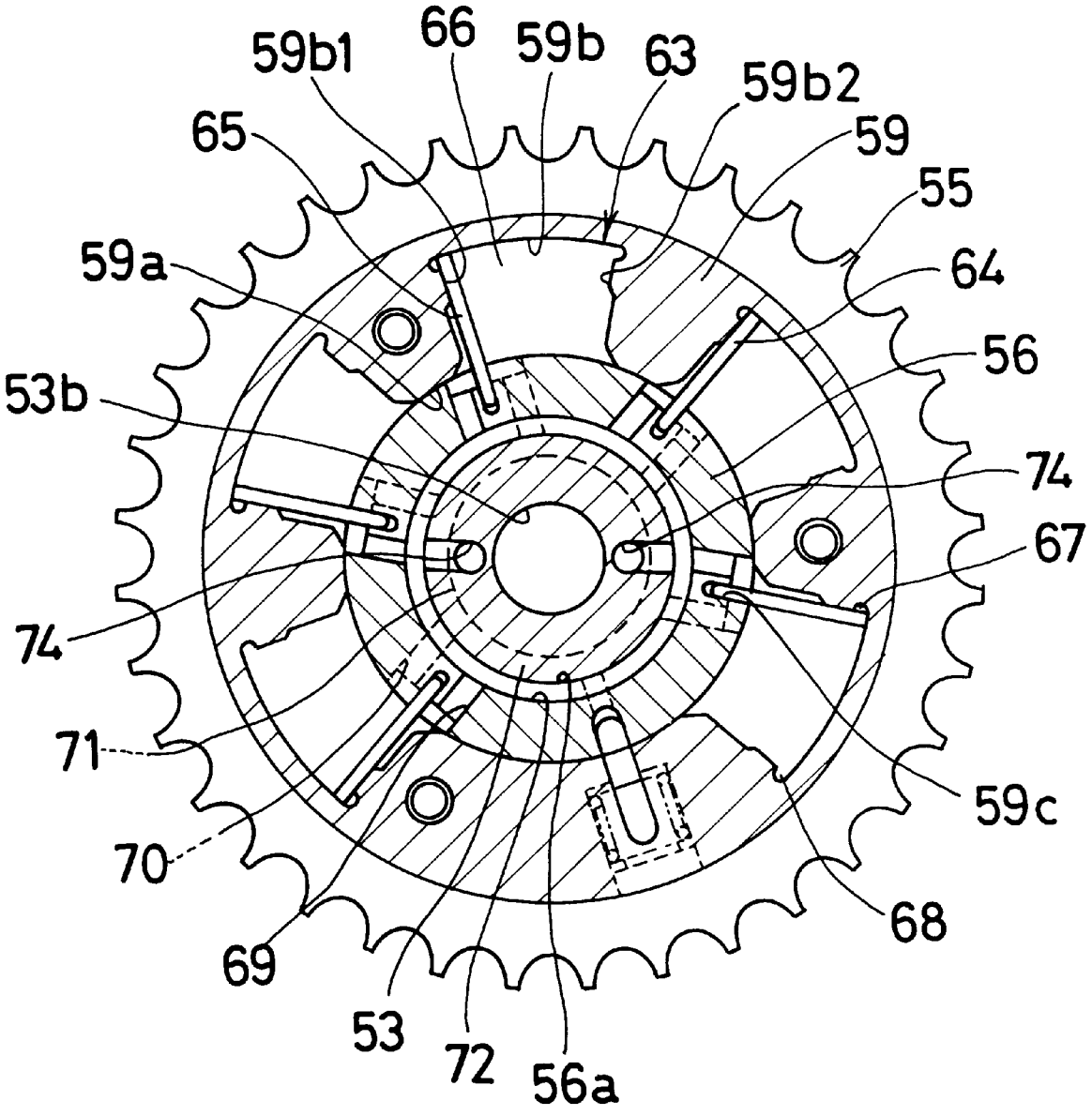
FIG. 7 shows a cross-sectional view taken along line VII—VII of FIG. 6.

FIG. 6 and FIG. 7 show a third embodiment of the present invention. In FIG. 6 and FIG. 7, the same parts as compared with FIG. 1 and FIG. 2 are identified by the same reference numerals.

Referring to FIG. 6 and FIG. 7, a cam shaft 50 which is provided with a plurality of cam portions 51 that drive valves (not shown) is rotatably supported on a cylinder head 54 of an engine at its plural journal portions 52. Now, the cylinder head 54 is provided with a plurality of semicircular supporting portions 54*a* and a plurality of covers (not shown) each of which has the corresponding semicircular supporting portion opposite to each of the supporting portions 54*a* are fixed to the cylinder head 54 so that the journal portions 52 are rotatably supported between the supporting portions 54*a* of the cylinder head 54 and the supporting portions of the cover.

An end 53 of the cam shaft 50 projects out of the cylinder head 54 and a timing gear 55 is rotatably mounted on this projecting end 53 of the cam shaft 50. Rotational torque is transmitted to the timing gear 55 via a chain 57 from a crank shaft 58 which is rotated by the engine. The timing gear 55 is provided with three female screw holes which extend in the axial direction and are separated in the circumferential direction by regular intervals. The timing gear 55 is provided with a circular projecting portion 55*a* that projects in the axial direction at its one end surface with a flat surface at its other end surface. The circular projecting portion 55*a* can be contacted with a flange portion 53*a* which is formed on the outer circumferential portion of the projecting end 53 of the cam shaft 50.

A cylindrical rotor 56 having a stepped inner bore 56*a* is fixedly mounted on the projecting end 53 of the cam shaft 50 by a pin (not shown) so that relative rotation between the rotor 56 and the cam shaft 50 is prevented. The rotor 56 is fitted onto the projecting end 53 of the cam shaft 50 at its large diameter portion of the stepped inner bore 56*a* and a stepped portion between the large diameter portion and a small diameter portion of the stepped inner bore is in contact with a top surface of the projecting end 53 of the cam shaft 50. One side surface of the rotor 56 is in contact with the flat surface of the timing gear 55. A cylindrical housing member 59 having a inner bore 59*a* is rotatably mounted on the outer circumferential surface of the rotor 56 so as to surround the rotor 56. The housing member 59 has the same axial length as the rotor 56 and is provided with five grooves 59*b* which outwardly extend from the inner bore 59*a* in the radial direction and which are separated in the circumferential direction. The housing member 59 is further provided with three penetrating holes in the axial direction which are separated from each other at regular intervals. One side surface of the housing 59 is in contact with the flat surface of the timing gear 55. A circular front plate 60 that is provided with three penetrating holes in the axial direction which are separated from each other at regular intervals is disposed adjacent to the other side surfaces of the rotor 56 and the housing member 59. Each of the holes of the front plate 60, each of the holes of the housing member 59 and each of the female screw holes of the timing gear 55 are coaxially arranged with each other, and a bolt 61 is fitted into each of the coaxially arranged holes. Each of the bolts 61 is screwed into each of the female screw holes of the timing gear 55. As a result, the rotor 56, the housing member 59, the timing gear 55 and the front plate 60 are united. The flat surface of the timing gear 55 is fluid-tightly pressed onto one side surface of the rotor 56 and of the housing member 59; one side surface of the front plate 60 is fluid-tightly pressed onto the other side surface of the rotor 56 and of the housing member 59.

A central screw hole 53*b* which is opened outside and whose diameter is almost the same as that of the front plate 60 are formed at an axial center of the projecting end 53 of the cam shaft 50. A central bolt 62 is screwed into the central screw hole 53*b* whereby the rotor 56 is fixed to the projecting end 53 of the cam shaft 50.

As a result of the above, five chambers 63 which are separated in the circumferential direction and each of which has a pair of circumferentially opposed walls 59*b*1, 59*b*2 are defined among the rotor 56, the housing member 59, the front plate 60 and the timing gear 55. On the outer circumferential portion of the rotor 56, six grooves 59*c* which extend inwardly therefrom in the radial direction and which are separated in the circumferential direction are formed thereon. Five vanes 64 which extend outwardly in the radial direction into the chambers 63 are mounted in the grooves 59*c*, respectively. Thereby, each of the chambers 63 is divided into a first pressure chamber 65 and a second pressure chamber 66, both of which are fluid-tightly separated from each other. In this embodiment, grooves 67, 68 which extend in the axial direction are formed on the radially outer end portions of the opposed walls 59*b*1, 59*b*2, respectively.

The rotor 56 is provided with five first passages 69 and five second passages 70. One end of each of the first passages 69 communicates with a circular groove 72 that is formed on the large diameter portion of the stepped bore 56*a* of the rotor 56. The other end of each of the first passages 69 is communicated with each of the first pressure chambers 65. On the other hand, one end of each of the second passages 70 communicates with a circular groove 71 that is formed on the outer circumferential portion of the projecting end 53 of the cam shaft 50. The other end of each of the second passages 70 communicates with each of the second pressure chambers 66. The circular groove 72 is communicated with a pair of grooves 73 that are symmetrically formed relative to the axial center of the cam shaft 50 on the top surface of the projecting end 53 of the cam shaft 50. The grooves 73 communicate with a pair of passages 74 that are formed on a coaxial circle about the axial center of the cam shaft 50 and which extend in the axial direction. The circular groove 71 communicates with a pair of passages 75 via a pair of passages 76 that are symmetrically formed with respect to the axial center of the cam shaft 50 in the projecting end 53 and that extend in the radial direction. The passages 75 are formed on the coaxial circle about the axial center of the cam shaft 50 and are separated from the passages 74 in the circumferential direction at a predetermined angle. The passages 75 extend in the axial direction and a ball 76 is pressed into one end of each of the passages 75 that opens toward the stepped portion of the rotor 56.

A pair of circular grooves 78 and 79 are formed on the journal portion 52 of the cam shaft 50. The circular groove 78 communicates with the passages 74 via a pair of passages 80 that extend in the radial direction. The circular groove 79 communicates with the passages 75 via a pair of passages 81 that extend in the radial direction.

A fluid supplying device 90 is comprised of a changeover valve 91, a fluid pump 92 and a controller 93. In this embodiment, the changeover valve 91 is a four-port-three-position type electromagnetic valve. The fluid pump 92 is driven by the engine and discharges the fluid (=oil) for lubricating the engine. The pump 92 may be a pump for lubricating the engine. The circular groove 78 communicates to a port A of the changeover valve 91 and the circular groove 79 communicates to a port B of the changeover valve 91. A port P of the changeover valve 91 communicates to a discharge portion the fluid pump 92 and a port R of the changeover valve 91 communicates with a reservoir 94. The position of the changeover valve 91 is controlled by the controller 93 so that a first condition in which the discharged fluid from the pump 92 is supplied to the circular groove 78 and in which the circular groove 79 is communicated to the reservoir 94, a second condition in which the communication between the circular grooves 78, 79 and the pump 92 and the reservoir 94 are interrupted, respectively and in which the discharged fluid from the pump 92 is supplied to the reservoir 94 and a third condition in which the discharged fluid from the pump 92 is supplied to the circular groove 79 and in which the circular groove 78 is communicated to the reservoir 94 are selectively obtained. The controller 93 controls the above conditions of the changeover valve 91 based on parameter signals such as engine speed, the opening level of a throttle valve (not shown) and so on.

The operation of the valve timing control device having the above structure will now be described.

With the starting of the engine, the cam shaft 50 is rotated clockwise by the timing gear in FIG. 7. As a result, the housing member 59 is rotated and the rotational torque of the housing member 59 is transmitted to the rotor 56 via the vanes 64. Then, the cam shaft 50 is rotated clockwise in FIG. 7 and the valves (not shown) are opened and closed.

The timing gear 55 is rotatably mounted on the projecting end 53 of the cam shaft 50. Consequently, when the pressurized fluid is supplied from the pump 92 to the first pressure chambers 65 by the changeover valve 91 changed to the third condition via the circular groove 79, the passages 81 and 74, the grooves 73, the circular groove 72 and the first passages 29, the vanes 64 and the rotor 56 are rotated clockwise relative to the housing member 59 and the timing gear 55 in FIG. 7 until the vanes 64 are in contact with the walls 59*b*2. The valve timing control device is, therefore, in the maximum advanced condition position in which the angular phase of the cam shaft 50 is advanced relative to that of the crank shaft 58 by a predetermined maximum valve. In this condition, when the pressurized fluid is supplied from the pump 92 to the second pressure chambers 66 by the changeover valve 91 changed to the first condition via the circular groove 78, the passages 80, 75 and 77, the circular groove 78 and the second passages 70, the vanes 64 and the rotor 56 are rotated counterclockwise relative to the housing member 59 and the timing gear 55 in FIG. 7 until the vanes 64 are in contact with the walls 59*b*1. The valve timing control device is, thus, in the maximum retarded condition position in which the angular phase of the cam shaft 50 is retarded relative to that of the crank shaft 58 by a predetermined maximum value. Now, depending on the manner in which the control of the changeover valve 91 is executed, the vanes 64 can be stopped in any position (intermediate advanced position) between the maximum advanced position and the maximum retarded position. This requires that balance be achieved between the fluid pressure of the first pressure chambers 65 and the fluid pressure of the second pressure chambers 66 when the vanes 64 have achieved an arbitrary position. The amount of the advance can therefore be set to any value between a zero level and a maximum level.

As mentioned above, the opening and closing timing of the valves (not shown) driven by the cam shaft 50 is adjusted and the angular phase difference between the crank shaft 58 and the cam shaft 50 is adjusted.

Further, in this embodiment, since the grooves 67 and 68 which extend in the axial direction are formed on the radially outer end portions of the opposed walls 59*b*1 and 59*b*2, respectively, it is able to obtain the same effects as the above first embodiment. Now, in this embodiment, the contacting portions between the front plate 60 and the housing member 59 and between the timing gear 55 and the housing member 59 are sealed by a metal touch, respectively. However, it is able to interpose a seal member which is bent so that the bolts 61 are located outside of the seal portion, respectively as shown in FIG. 2. In this embodiment, the cam shaft 50 may be an exhaust cam shaft or may be an intake cam shaft.

As mentioned above, according to the present invention, since the concave portions are formed on the radially outer end portions of the opposed walls of the chambers, respectively, even if the fluid which contains foreign matter is supplied to the chambers, the foreign matter is moved outwardly in the radial direction by the centrifugal force due to the rotation of the rotor and collected into the concave portions. Accordingly, since foreign matter is prevented from locating between the vanes and the walls, the amount of the maximum advance or the maximum retard is always maintained at the predetermined amount. Further, if foreign matter is located between the vanes and the walls and removed therefrom, the foreign matter may reach between the top end portion of the vanes and the outer circumferential walls of the chambers such that the fluid-tightness between each of the first pressure chambers and each of the second pressure chambers may deteriorate. In the present invention, however, since the foreign matter is always collected into the concave portions, the deteriorating bad effects of the foreign matter is prevented and, therefore, it is able to maintain the good response of the valve timing control device.

The principles, a preferred embodiment and modes of operation of the present invention have been described in the foregoing description. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A valve timing control device comprising:

a rotor fixed on a cam shaft of an engine;

a housing member rotatably mounted on the cam shaft so as to surround the rotor;

a chamber defined between the housing member and the rotor and having a pair of circumferentially opposing walls;

a vane provided with the rotor and extending outwardly therefrom in the radial direction into the chamber so as to divide the chamber into a first pressure chamber and a second pressure chamber;

a first fluid passage for supplying and discharging a fluid to and from the first pressure chamber;

a second fluid passage for supplying and discharging a fluid to and from the second pressure chamber; and a concave portion formed on the radially outer ends of the opposing walls of the chamber.

2. A valve timing control device in claim 1, wherein the concave portion is a groove which is extended in the axial direction.

3. A valve timing control device in claim 2, wherein foreign matter which is contained in the fluid supplied to the chamber is collected into the grooves by the centrifugal force due to the rotation of the rotor.

4. A valve timing control device in claim 3, wherein the cam shaft is directly rotated by rotational torque from a crank shaft of the engine and the housing member is connected to another cam shaft via a rotational torque transmitting means.

5. A valve timing control device in claim 4, wherein at least one of the first and second fluid passages includes passages which are formed in the cam shaft so as to extend outwardly from the axial center of the cam shaft in the radial direction.

6. A valve timing control device in claim 5 further comprising a fluid supplying means for supplying the fluid to the first and second fluid passages, wherein the fluid supplying means includes a fluid pump from which fluid under pressure is supplied, and an electromagnetic changeover valve connected to the fluid pump and alternately connected to the first fluid passage and the second fluid passage and a controller for controlling the control position of the changeover valve.

7. A valve timing control device in claim 6, wherein the plural number of the chamber are defined between the housing member and the rotor and the plural number of the vanes are mounted on the rotor so as to divide the chambers into the first pressure chambers and the second pressure chambers, respectively.

8. A valve timing control device in claim 3, wherein the housing member is directly rotated by rotational torque from the crank shaft of the engine.

9. A valve timing control device in claim 8 further comprises a fluid supplying means for supplying the fluid to the first and second fluid passages, wherein the fluid supplying means includes a fluid pump from which fluid under pressure is supplied, an electromagnetic changeover valve connected to the fluid pump and alternately connected to the first fluid passage and the second fluid passage and a controller for controlling the control position of the changeover valve.

10. A valve timing control device in claim 9, wherein the plural number of the chamber are defined between the housing member and the rotor and the plural number of the vanes are mounted on the rotor so as to divide the chambers into the first pressure chambers and the second pressure chambers, respectively.

11. A valve timing control device comprising:

a rotor fixed on a cam shaft of an engine;

a housing member rotatably mounted on the cam shaft so as to surround the rotor;

a chamber defined between the housing member and the rotor and having a pair of circumferentially opposing walls;

a vane provided with the rotor and extending outwardly therefrom in the radial direction into the chamber so as to divide the chamber into a first pressure chamber and a second pressure chamber;

a first fluid passage for supplying and discharging a fluid to and from the first pressure chamber;

a second fluid passage for supplying and discharging a fluid to and from the second pressure chamber; and a concave portion formed on the radially outer ends of the opposing walls of the chamber and the vane when the volume of the first pressure chamber and the second pressure chamber is at a minimum.

12. A valve timing control device comprising:

a rotor adapted to be fixed on a cam shaft of an engine, a housing member surrounding the rotor, a chamber defined between the housing member and the rotor and having a pair of circumferentially opposed walls, a vane provided with the rotor and extended outwardly therefrom in the radial direction into the chamber so as to divide the chamber into a first pressure chamber and a second pressure chamber, a first fluid passage for supplying and discharging a fluid to and from the first pressure chamber, a second fluid passage for supplying and discharging a fluid to and from the second pressure chamber, and a groove formed in the radially outer end of the opposed walls of the chamber.

13. A valve timing control device comprising:

a rotor adapted to be fixed on a cam shaft of an engine, a housing member surrounding the rotor, a chamber defined between the housing member and the rotor and having first and second of circumferentially opposed walls, a vane provided with the rotor and extended outwardly therefrom in the radial direction into the chamber so as to divide the chamber into a first pressure chamber formed between the vane and the first wall and a second pressure chamber formed between the vane and the second wall, a first fluid passage for supplying and discharging a fluid to and from the first pressure chamber, a second fluid passage for supplying and discharging a fluid to and from the second pressure chamber, and a groove provided between an inner surface of the first wall and the vane at the radially outer end of the chamber so as to collect foreign matter thereinto when the volume of the first pressure chamber is at a minimum.

14. A valve timing control device as recited in claim 13, wherein the groove is formed in the first wall.

* * * * *